United States Patent [19]

Külker

[11] 4,027,820

[45] June 7, 1977

[54] SELF-CLEANING CENTRIFUGAL DRUM FOR THE PERIODICAL REMOVAL OF A PORTION OF THE SOLIDS SEPARATED FROM A LIQUID AND COLLECTING IN THE PERIPHERAL PART OF THE INTERIOR OF THE DRUM

[75] Inventor: Otto Külker, Rietberg, Germany

[73] Assignee: Westfalia Separator AG, Germany

[22] Filed: Aug. 24, 1976

[21] Appl. No.: 717,300

[30] Foreign Application Priority Data

Aug. 30, 1975 Germany ..... 2538630

[52] U.S. Cl. ..... 233/20 A

[51] Int. Cl.[2] ..... B04B 3/02

[58] Field of Search ..... 233/20 R, 20 A, 19 R, 233/19 A

[56] References Cited

UNITED STATES PATENTS 3,371,859 3/1968 Lyskovtsov ..... 233/20 R

*Primary Examiner*—George H. Krizmanich

*Attorney, Agent, or Firm*—Burgess, Dinklage & Sprung

[57] ABSTRACT

Closing piston 5 can be lowered under the influence of the weight of solids in the separating chamber 4 so that solids are ejected through annular opening 19 and into annular gap 18. The closing piston 5 can then be raised to close the opening 19. Thereafter the pumping piston 7 can be raised to pump the ejected solids upwardly in the annular gap 18 for discharge of the solids over the lip 3*a*.

3 Claims, 1 Drawing Figure

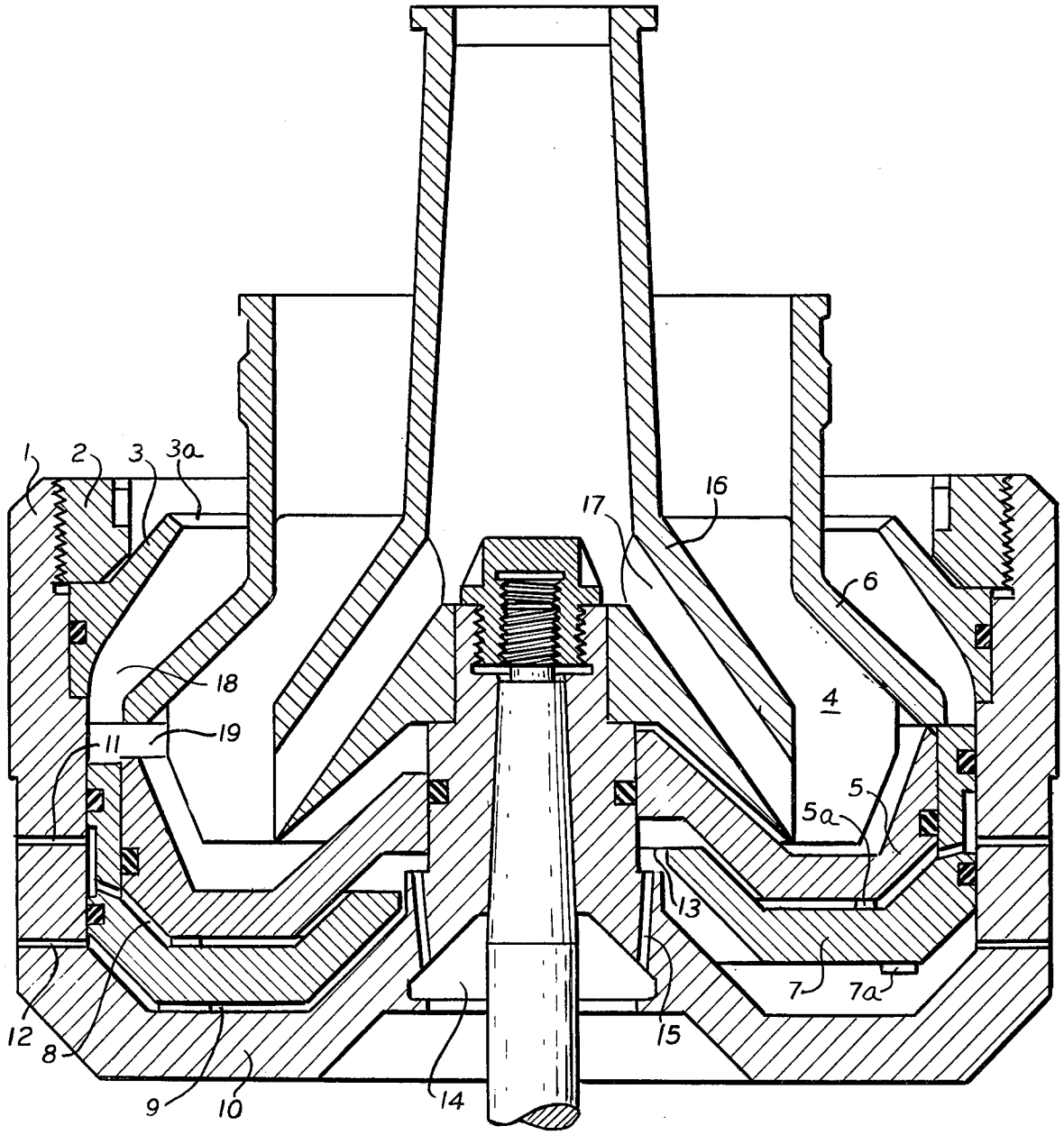
1
2
3
3a
16
17
6
18
4
19
11
5
5a
13
7
7a
12
8
15
9
10
14

SELF-CLEANING CENTRIFUGAL DRUM FOR THE PERIODICAL REMOVAL OF A PORTION OF THE SOLIDS SEPARATED FROM A LIQUID AND COLLECTING IN THE PERIPHERAL PART OF THE INTERIOR OF THE DRUM

BACKGROUND

The invention relates to a self-cleaning centrifuge drum for the periodical removal of a portion of the solids separated from a liquid and collecting in the peripheral part of the interior of the drum. Such a drum is known, for example, from British Pat. No. 373,117.

In this known drum, the lower portion of the drum is provided in the plane of its greatest inside diameter with a plurality of openings distributed about its circumference, which are periodically opened by an axially displaceable annular operating piston which externally envelops the lower portion of the drum. In its axial movements it is guided on the inside against the cylindrical outer surface of the lower part of the drum and on the outside on the cylindrical inside surface of a housing partially surrounding the drum and rotating with it. The housing is of bowl-shaped construction, and its free margin extends axially slightly above the openings disposed in the lower part of the drum. The drum has two control chambers for the actuation of the operating piston, each provided with one emptying bore and the control liquid being fed to them alternately through a three-way valve.

The operating piston has on its outside two annular flanges which are inclined toward one another and terminate at a distance apart from one another. In this manner an annular pocket is formed which opens toward the outside. Between the flanges, openings are created in the operating piston whose number is the same as that of the openings disposed in the lower part of the drum and which are in radial alignment with the latter.

When the upper control chamber is filled with control liquid, the operating piston moves to its lower end position. In this state, the openings in the operating piston and in the periphery of the lower part of the drum are in line with one another, so that the pocket, which acts as a lock, is in communication with the interior of the drum. In this position the pocket is closed on the outside, because the upper annular flange of the operating piston reaches into the bowl-shaped housing surrounding the drum and lies against its inner margin. The pocket fills with solids, which very soon displace inwardly most of the accompanying liquid, since they are in the area of greatest centrifugal force.

When the lower control chamber is filled with control liquid, the operating piston moves to its upper end position, whereupon the lock is separated from the inner chamber of the drum, and when the separation has been accomplished the annular pocket is opened at its periphery. The solids in the pocket are let out in this manner as through a lock.

In the known drum, it is a disadvantage that the operating piston and the housing serving for its outer guidance are on the outside of the drum periphery. They are thus located in the area of greatest centrifugal force, so that even slight irregularities will decidedly interfere with the smooth running of the drum. Even the air friction is considerably greater than it is on drums with a plain periphery. But the greatest disadvantage lies in the fact that both the operating piston and the housing partially enveloping it are of bowl-like construction and cannot be supported at the outside. It is known that a rotating hollow cylinder expands three times as much as a disk of the same diameter rotating at the same rotatory speed. For this reason, the transition between the cylindrical drum periphery and the discoidal bottom of the drum constitutes the most critical zone.

Due to the fact that, in the known drum, the free upper margin of the operating piston and the free upper margin of the housing rotating with the drum are able to expand freely under the action of centrifugal force, a perfect sealing of the interior chamber of the drum cannot be achieved. This may also be the reason why the drum disclosed by the British Pat. No. 373,117 has never been adopted in practice.

THE INVENTION

The invention is addressed to the problem of creating a self-cleaning centrifugal drum for the periodical removal of a portion of the solids separated from a liquid and gathering in the peripheral part of the drum interior, in which the means periodically opening the drum and producing the partial ejection of the solids is disposed in the interior of the drum and is supported against the drum periphery.

The invention is characterized by an axially displaceable closing piston defining the bottom of the separating chamber of the drum, and a likewise axially displaceable pumping piston which encompasses the closing piston and periodically forces over a lip and out of the drum the solids located outside of the drum interior, the pistons being operated by feeding control liquid to the control chambers.

The drum can be so constructed that only two control chambers are necessary for the operation of both pistons. In further development of the invention, the two control chambers can communicate with one another adjacent the axis of rotation, so that, after filling the upper control chamber, the control liquid can pass over into the lower control chamber.

An embodiment of the invention is represented in the drawing, wherein on the left, the drum is in the open position and on the right, in the closed position.

The number 1 designates the drum housing or bottom part of the drum, and 3 is the top part which is turned in to form an overflow lip *3a* for the solids. The two parts are held together by a lock ring 2. The separating chamber 4 of the drum is defined at the bottom by the closing piston 5 and at the top by the separating plate 6. The closing piston 5 is encompassed by the pumping piston 7. The closing piston 5 and separating plate 6 are disposed radially inwardly of the housing 1 so as to define annular gap 18 between the housing and the closing piston and separating plate. Between the two pistons there is a control chamber 8 and between the pumping piston and the drum bottom 10 there is a control chamber 9. The control chamber 8 is provided with a discharge bore 11 and the control chamber 9 with a discharge bore 12. The two control chambers communicate with one another at 13. Control liquid delivered into the receiving trough 14 flows through one or more bores 15, first into the control chamber 8, and, if more control liquid is delivered than can escape through the discharge bore 11, it passes over at 13 into control chamber 9. The mixture of liquid and solids to be separated is fed to the drum through the distributor 16 and the bores 17. Spacer lugs *5a*, and *7a* are mounted, respectively on pistons 5 and 7, and in part define the closing chambers.

The drum operates in the following manner:

First, control liquid is delivered to the receiving trough 14 at such a rate that control chamber 8 fills and the closing piston 5 moves upwardly and firmly engages the separating plate 6. Also, so much control liquid can be fed in that the pumping piston, too, will be in its upper end position (right half of the drawing). After the mixture of liquid and solids begins to enter the drum, the solids separated from the liquid collect in the outer portion of the separating chamber 4, while the clarified liquid continuously leaves the drum over the upper edge of the separating plate 6.

At the end of a certain centrifuging time, when a sufficiently deep layer of solids has formed, the control liquid feed is shut off. The control chambers 8 and 9 empty through the bores 11 and 12. The two pistons 5 and 7 move downward under the pressure of the drum charge, and the solids partially emerge through the annular opening 19 between the closing pistons 5 and the separating plate 6 into the annular gap 18 between the separating plate 6 and the drum top 3 (left-hand side of the drawing). At the end of another centrifuging period, control fluid is fed in with an excess so that the two control chambers will fill one after the other. The closing piston moves upward first and seals the separating chamber of the drum from the outer space. Then the pumping piston moves upward and pushes the solids towards the edge of the lip 3, over which they can escape from the drum.

The control fluid input is then shut off again, and after a certain period of time it is reopened.

SUMMARY

Thus, the invention provides a self-cleaning centrifugal drum for separating solids from a liquid for the periodic removal of solids separated from the liquid. The drum comprises a closing piston disposed in the lower part of the housing, and a separator plate disposed in the upper part of the housing. The closing piston and separator plate define a separating chamber for the separation, and are disposed radially inwardly of the housing so as to define an annular gap between the housing and the closing piston and separator plate. A pumping piston is disposed in the lower part of the drum encompassing the closing piston and extending upwardly into the annular gap. Means define a closing piston control chamber between the pistons, and means define a pumping piston control chamber between the pumping piston and the bottom of the drum. Means are provided for supplying and discharging control liquid to the control chambers for supplying control liquid to the closing piston control chamber for raising the closing piston into sealing relation with the separating plate and lowering the closing piston, in response to weight of the solids in the drum, for discharge of solids from the separating chamber into the annular gap. The last mentioned means are further for raising the pumping piston only after and while the closing piston is in said sealing relation for pumping of solids discharged into the annular gap, upwardly in the annular gap, and for lowering the pumping piston below the lower level of the separator plate for permitting the discharge of solids into the annular gap.

What is claimed is:

1. Self cleaning centrifugal drum for separating solids from a liquid constructed for the periodic removal of solids separated from the liquid comprising:

a. a rotating drum housing, a closing piston disposed in the lower part of the housing, and a separating plate disposed in the upper part of the housing, the closing piston and separating plate defining a separating chamber for said separation, and are disposed radially inwardly of the housing so as to define an annular gap between the housing and the closing piston and separating plate, b. a pumping piston disposed in lower part of the drum encompassing the closing piston and extending upwardly into the annular gap, means defining a closing piston control chamber between the pistons and means defining a pumping piston control chamber between the pumping piston and the bottom of the housing, and c. means for supplying and discharging control liquid to the control chambers for supplying control liquid to the closing piston control chamber for raising the closing piston into sealing relation with the separating plate and lowering the closing piston, in response to weight of the solids in the drum, for discharge of solids from the separating chamber into the annular gap, and for raising the pumping piston only after and while the closing piston is in said sealing relation for pumping of solids discharged into the annular gap, upwardly in the annular gap, and for lowering the pumping piston below the lower level of the separating plate for permitting the discharge of solids into the annular gap.

2. Centrifugal drum according to claim 1, wherein the control chambers are in communication adjacent the drum axis.

3. Centrifugal drum according to claim 1, the means for supplying control liquid being for supplying control liquid to the closing piston control chamber, the control chambers being in communication adjacent the drum axis for overflow of control liquid from the closing piston control chamber of the pumping piston control chamber.

* * * * *